US012180676B2

(12) United States Patent
Gentle

(10) Patent No.: US 12,180,676 B2
(45) Date of Patent: Dec. 31, 2024

(54) ANTI-BOUNCE CONTROL SYSTEMS FOR MACHINES, AND ASSOCIATED METHODS

(71) Applicant: Caterpillar Inc., Peoria, IL (US)

(72) Inventor: Michael C. Gentle, Maroa, IL (US)

(73) Assignee: Caterpillar Inc., Peoria, IL (US)

( * ) Notice: Subject to any disclaimer, the term of this patent is extended or adjusted under 35 U.S.C. 154(b) by 842 days.

(21) Appl. No.: 17/373,463

(22) Filed: Jul. 12, 2021

(65) Prior Publication Data

US 2023/0008505 A1 Jan. 12, 2023

(51) Int. Cl.

| | |
|---|---|
| ***E02F 9/20*** | (2006.01) |
| ***E02F 3/76*** | (2006.01) |
| ***E02F 3/84*** | (2006.01) |
| ***E02F 9/08*** | (2006.01) |
| ***E02F 9/22*** | (2006.01) |

(52) U.S. Cl.

CPC ..... *E02F 3/841* (2013.01); *E02F 3/764* (2013.01); *E02F 9/0841* (2013.01); *E02F 9/225* (2013.01); *E02F 9/2257* (2013.01)

(58) Field of Classification Search

CPC ..... E02F 3/764; E02F 3/841; E02F 9/0841; E02F 9/2207; E02F 9/225; E02F 9/2257

See application file for complete search history.

(56) References Cited

U.S. PATENT DOCUMENTS

| | | | | |
|---|---|---|---|---|
| 6,112,145 | A | 8/2000 | Zachman | |
| 7,793,740 | B2 | 9/2010 | Thomson et al. | |
| 8,393,429 | B2 * | 3/2013 | Thomson | E02F 9/225 180/209 |
| 8,548,680 | B2 | 10/2013 | Ryerson et al. | |
| 8,869,908 | B2 | 10/2014 | Zhu et al. | |
| 9,051,711 | B2 | 6/2015 | Sharma et al. | |
| 9,103,098 | B2 | 8/2015 | Zhu | |
| 9,234,331 | B1 | 1/2016 | Sharma et al. | |
| 2011/0108294 | A1 | 5/2011 | Thomson et al. | |
| 2015/0008006 | A1 * | 1/2015 | Zhu | E02F 9/265 172/3 |
| 2015/0197253 | A1 | 7/2015 | Zhu | |
| 2015/0259882 | A1 * | 9/2015 | Sharma | E02F 9/225 701/41 |

(Continued)

OTHER PUBLICATIONS

Matchinski, Cassandra, "12 Tips for Motor Graders," Equipment Management Technical Services Program, The Bridge, available at https://www.emtsp.org/2016/02/10/4274/, Winter 2015-2016, 3 pgs.

(Continued)

*Primary Examiner* — Gary S Hartmann

(74) *Attorney, Agent, or Firm* — Perkins Coie LLP

(57) ABSTRACT

Systems to control movement of a motor grader include a sensor for providing a bounce signal indicative of a bouncing movement of the motor grader, and a controller programmed with instructions that, when executed: receive the bounce signal from the sensor; analyze the bounce signal from the sensor; determine whether the maximum amplitude of the bouncing movement exceeds a threshold; in response to determining whether the maximum amplitude exceeds the threshold, generate an articulation angle command signal to change an articulation angle of the motor grader; and transmit the articulation angle command signal to change the articulation angle.

20 Claims, 7 Drawing Sheets

(56) References Cited

U.S. PATENT DOCUMENTS

2015/0376863 A1* 12/2015 Ziegenmeyer ..... E02F 9/2217
280/446.1

OTHER PUBLICATIONS

Caterpillar Inc., "5 Reasons to Banish Motor Grader Bounce," downloaded from https://www.cat.com/en_US/articles/ci-articles/5-reasons-to-banish-motor-grader-bounce.html, Jul. 7, 2021, 5 pgs.
Stewart, Larry, "How to Use Motor Graders to Build Better Roads," Construction Equipment, available at https://www.constructionequipment.com/use-all-motor-graders-features-build-roads-better, Sep. 28, 2010, 8 pgs.

* cited by examiner

ANTI-BOUNCE CONTROL SYSTEMS FOR MACHINES, AND ASSOCIATED METHODS

TECHNICAL FIELD

The present disclosure relates to controlling a machine and, more particularly, to systems and methods for mitigating harmonic vibrations of construction or agricultural machines, such as graders.

BACKGROUND

A motor grader is a machine with a propulsion mechanism and a leveling device for creating a flat or uniform surface during construction or agricultural work, or for other activities. A common motor grader includes wheels and a moldboard (sometimes called a blade). The wheels drive the grader and the moldboard along the surface to push earth or other material to flatten the surface or otherwise create a uniform grade or other contour for a roadway, parking lot, construction site, agricultural plot, landfill, or other areas.

Some machines, including motor graders, have a natural frequency that may negatively affect their operation when oscillations of the machines are at or near the natural frequency (i.e., resonance). Characteristics of the machines and their operating conditions may affect the natural frequency. Oscillations at the natural frequency of a motor grader may result in harmonic vibrations of the motor grader that are commonly called "bounce." Generally, bouncing relates to harmonic vibrations that can occur when the grader is operated at certain speeds and under certain loads against the moldboard.

When a grader has entered a bounce mode, the moldboard may periodically lose contact with the surface, so the resulting surface may be damaged with inconsistencies (which may include waves, scallops, washboards, corrugations, or other inconsistencies) that may require costly reworking, which may involve undesirable extra passes with the grader that uses additional fuel and time. Bounce also accelerates wear on components, which increases the risk of premature failure. Bounce may also cause an operator to become fatigued from being in a jarring or uncomfortable environment.

Motor grader bounce can include pitching forward and backward, rolling side to side, "duck-walking," and/or general vibration. As a motor grader's wheels move through the inconsistencies created by the moldboard, the motor grader may pitch forward or backward and/or side to side, further exacerbating bounce.

An operator may mitigate bounce by articulating the motor grader or adjusting its speed. However, manual control to mitigate bounce may require an operator to focus intensely on manually controlling throttle speed, articulation, and/or steering, which may cause operator fatigue or operator error.

Efforts have been made to automatically mitigate bounce by automatically adjusting speed. For example, U.S. Pat. No. 8,869,908 relates to a system that determines a maximum amplitude of bounce of a grader and adjusts the ground speed of the grader based on the maximum amplitude of bounce. However, it may not always be desirable to adjust the speed of a motor grader during operation.

Systems and methods according to embodiments of the present technology, as described herein, and variants thereof, are directed toward overcoming one or more of the deficiencies described above and/or other problems with the prior art.

SUMMARY

In some embodiments, a motor grader (or another machine) includes a front frame and a rear frame, wherein the front frame is configured to articulate relative to the rear frame about an articulation angle. In some embodiments, a method for controlling movement of a motor grader includes: receiving, at a controller, a bounce signal from a first sensor, wherein the signal is indicative of a bouncing movement of the motor grader; analyzing, by the controller, the bounce signal from the first sensor, wherein analyzing the signal comprises determining a maximum amplitude of the bouncing movement of the motor grader based on the signal from the first sensor and determining whether the maximum amplitude exceeds an amplitude threshold; in response to determining whether the maximum amplitude exceeds the amplitude threshold, generating, by the controller, an articulation angle command signal to change the articulation angle; and transmitting the articulation angle command signal from the controller to change the articulation angle.

In some embodiments, a system for automated control of movement of a motor grader includes a first sensor carried by the motor grader and configured to provide a bounce signal indicative of a bouncing movement of the motor grader, and a controller programmed with instructions that, when executed: receive the bounce signal from the first sensor; analyze the bounce signal from the first sensor, wherein analyzing the bounce signal includes determining a maximum amplitude of the bouncing movement of the motor grader based on the signal from the first sensor; determine whether the maximum amplitude exceeds an amplitude threshold; in response to determining whether the maximum amplitude exceeds the amplitude threshold, generate an articulation angle command signal to change the articulation angle; and transmit the articulation angle command signal from the controller to change the articulation angle.

In some embodiments, a motor grader (or other machine) includes a rear frame and a front frame, wherein the front frame is configured to articulate relative to the rear frame about an articulation angle. In some aspects, the motor grader includes a first sensor carried by the motor grader and configured to provide a bounce signal indicative of a bouncing movement of the motor grader, and a controller programmed with instructions that, when executed: receive the bounce signal from the first sensor; analyze the bounce signal from the first sensor, wherein analyzing the bounce signal comprises determining a maximum amplitude of the bouncing movement of the motor grader based on the signal from the first sensor; determine whether the maximum amplitude exceeds an amplitude threshold; in response to determining whether the maximum amplitude exceeds the amplitude threshold, generate an articulation angle command signal to change the articulation angle; and transmit the articulation angle command signal from the controller to change the articulation angle. In some aspects, the first sensor includes an accelerometer or a hydraulic pressure sensor.

Other aspects will appear hereinafter. The features described herein can be used separately or together, or in various combinations of one or more of them.

BRIEF DESCRIPTION OF THE DRAWINGS

The systems and methods described herein may be better understood by referring to the following Detailed Description in conjunction with the accompanying drawings, in which like reference numerals indicate identical or functionally similar elements.

Figure 1:
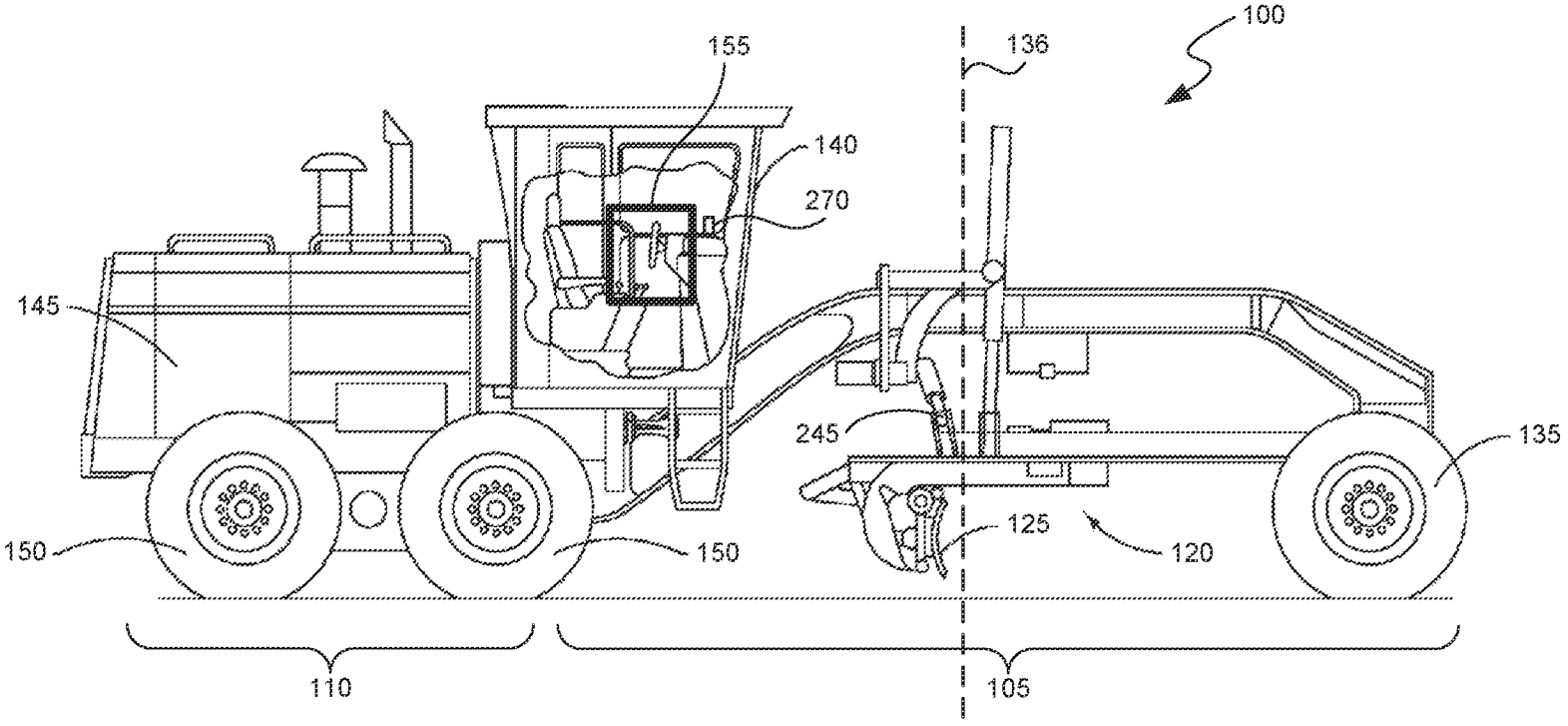
FIG. 1 is a side view of a machine configured in accordance with embodiments of the present technology.

The headings provided herein are for convenience only and do not necessarily affect the scope of the embodiments. Further, the drawings have not necessarily been drawn to scale. For example, the dimensions of some of the elements in the Figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to unnecessarily limit the embodiments described. Rather, the embodiments are intended to cover all modifications, combinations, equivalents, and alternatives falling within the scope of this disclosure.

DETAILED DESCRIPTION

Various embodiments of the present technology will now be described in further detail. The following description provides specific details for a thorough understanding and enabling description of these embodiments. One skilled in the relevant art will understand, however, that the techniques and technology discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description. Accordingly, embodiments of the present technology may include additional elements or exclude some of the elements described below with reference to the Figures, which illustrate examples of the technology.

The terminology used in this description is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such.

Disclosed are systems and methods for mitigating bounce of construction or agricultural machines, such as motor graders. According to embodiments of the present technology, if bounce is detected, the articulation and/or the steering of the machine is automatically adjusted to mitigate the bounce. For example, systems and methods according to embodiments of the present technology adjust the articulation and/or the steering of the machine to mitigate vertical bounce, pitching motions, side-to-side bounce (e.g., "duck walking"), vibration, and/or other forms of bounce.

Figure 2:
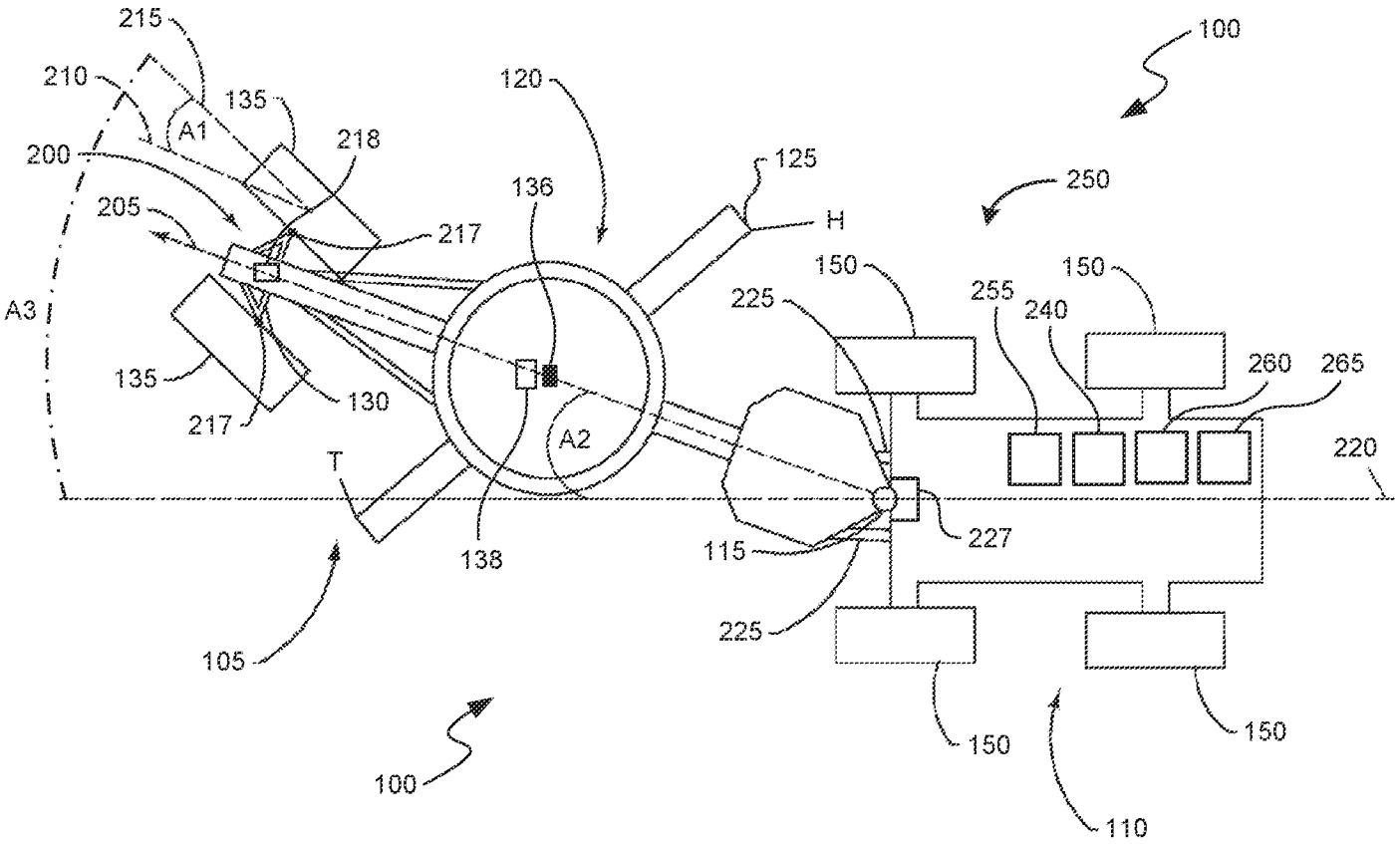
FIG. 2 is a schematic top view of the machine shown in FIG. 1.

FIG. 1 illustrates a side view of a machine 100 configured in accordance with embodiments of the present technology. FIG. 2 is a schematic top view of the machine 100. Although the machine 100 is illustrated as a motor grader, the machine 100 may be another machine capable of articulation, such as a wheel loader, a truck, a backhoe, or another vehicle.

With reference to FIGS. 1 and 2, the machine 100 may include a front frame 105, a rear frame 110, and an articulation joint 115 pivotally connecting the front frame 105 to the rear frame 110. The machine 100 may further include a work implement, which may be in the form of a moldboard assembly 120. For example, the moldboard assembly 120 may include a movable moldboard 125 for contouring or grading a surface, such as a surface of a construction site, an agricultural site, a roadway, or other surfaces.

The front frame 105 may support the moldboard assembly 120. The front frame 105 may include one or more front axles 130 that support one or more front traction devices 135. For example, the front traction devices 135 may be in the form of front wheels, such as two front wheels, supported on a single front axle 130. The front traction devices 135 are referred to hereinafter as front wheels 135. In some embodiments, the front axle 130 may be formed with two independent axles aligned along a single axis to effectively form a single front axle 130. The moldboard 125 may be movable up and down (i.e. toward or away from the surface) and it may be rotatable about an axis 136 to change the angle of the moldboard 125 relative to the path of travel of the machine 100. For context, the "toe" of the moldboard 125 is the forwardmost end of the moldboard while the "heel" of the moldboard 125 is the rearmost end (in FIG. 2, the "toe" is located at point T and the "heel" is located at point H). The machine 100 may include a circle angle sensor 138 that generates a signal indicative of the angle of the moldboard 125 (and consequently, which side of the machine 100 each of the heel and toe are located on). In some embodiments, the circle angle sensor 138 includes a rotary sensor connected to (e.g., mounted on) a hydraulic swivel associated with the moldboard assembly 120.

The rear frame 110 may support an operator cab 140, a power source 145 (which may be in the form of an engine or motor), and rear traction devices (such as rear wheels 150). Although the machine 100 may include features described above and illustrated in FIGS. 1 and 2, in some embodiments, the machine 100 may have other configurations.

The machine 100 may be steered via front wheel 135 steering and/or machine articulation, which may be controlled at least in part by an operator interface 155 (which may be in the operator cab 140 and/or in a remote control device). For example, as shown in FIG. 2, the machine 100 may include a front wheel steering apparatus 200, which may include suitable linkages and/or power devices for pivoting (steering) the front traction devices (front wheels 135) relative to the front frame 105. The machine 100 may also include articulation of the front frame 105 relative to the rear frame 110 via the articulation joint 115.

To illustrate front wheel steering, FIG. 2 shows several axes. FIG. 2 shows a longitudinal axis 205 of the front frame 105 (extending between the steering apparatus 200 and the articulation joint 115), an axis 210 that is parallel to the longitudinal axis 205, and a longitudinal axis 215 of a wheel 135 (extending between a forward point on the outer circumference of the wheel 135 and a rear point on the outer circumference of the wheel 135). A front wheel steering angle A1 is defined between the axis 210 and the longitudinal axis 215 of the wheel 135. In some embodiments, the front wheel steering angle A1 may range from −50 degrees to +50 degrees, or other ranges of angles, with zero degrees being attributed to alignment of the longitudinal axis 215 of the wheel 135 with the longitudinal axis 205 of the front frame 105. A positive front wheel steering angle A1 is associated with right steering, and a negative front wheel steering angle A1 is associated with left steering, depending upon the angle of machine articulation described below. Although the front wheel steering angle A1 is only shown for one of the front wheels 135, it is understood that the front wheels 135 operate in tandem with one another and are parallel to one another. In some embodiments, the front wheels 135 may pivot about corresponding pivot points 217, depending on the design of the linkage or other mechanism in the steering apparatus 200. The machine 100 may include a steering angle sensor 218 that generates a signal indicative of the front wheel steering angle A1. In some embodiments, the steering angle sensor 218 may include one or more position sensing cylinders that determine linear positions of portions of a wheel axis and convert the linear positions to the front wheel steering angle A1 based on the machine's axle geometry and dimensions. Any sensor capable of detecting an angle to indicate the front wheel steering angle A1 may be included in embodiments of the present technology.

To illustrate articulation, FIG. 2 also shows a longitudinal axis 220 of the rear frame 110. The longitudinal axis 220 of the rear frame 110 passes through a forward point on the rear frame 110 and a rear point on the rear frame 110. An articulation angle A2 is defined between the longitudinal axis 220 of the rear frame 110 and the longitudinal axis 205 of the front frame 105. An origin of the articulation angle A2 may be at the articulation joint 115. In some embodiments, the articulation angle A2 may range from −20 degrees to +20 degrees, or other ranges of angles, with zero degrees being attributed to an alignment of the longitudinal axis 220 with the longitudinal axis 205. A positive articulation angle A2 is associated with right articulation and a negative articulation angle A2 is associated with left articulation. A suitable mechanism may be used to cause the articulation of the front frame 105 relative to the rear frame 110, such as actuation or articulation cylinders 225, or other actuation or articulation devices, such as motors. The machine 100 may include an articulation angle sensor 227 that generates a signal indicative of the articulation angle A2. For example, in some embodiments, the articulation angle sensor 227 can include a rotary sensor that detects rotation between the front frame 105 and the rear frame 110. In some embodiments, the articulation angle sensor 227 can include a sensor mounted to the rear frame 110 and a linkage connecting the sensor to the front frame 105. The sensor can include a controller programmed with instructions that, when executed, convert the sensor/linkage position to the articulation angle A2 based on geometry and dimensions of the components. Any sensor capable of detecting angle to indicate the articulation angle A2 may be included in embodiments of the present technology.

The combination of front wheel steering and machine articulation results in a total steering angle A3 between the longitudinal axis 215 of the wheels 135 and the longitudinal axis 220 of the rear frame 110. For example, A3 may be the sum of A1 and A2. Articulation of the front frame 105 relative to the rear frame 110 may improve turning radius and maneuverability, while optionally facilitating a "crab steer" mode in which the front wheels 135 and the rear frame 105 travel in the same direction. For example, in a "crab steer" mode, the articulation angle A2 may be non-zero to offset the wheels 135 from the longitudinal axis 220 of the rear frame 110, and the machine 100 may be driven generally forward and steered with the front wheels 135 while the articulation angle A2 is non-zero. In a specific example, the articulation angle A2 may be non-zero while the longitudinal axis 215 of the wheels 135 is generally parallel to the longitudinal axis 220 of the rear frame 110.

Systems configured in accordance with embodiments of the present technology detect movements of the machine 100 that are indicative of bounce and, in response, automatically steer and/or articulate the machine 100. To detect and analyze bounce, the machine 100 may include one or more bounce sensors that provide data that is indicative (directly or indirectly) of the movement (e.g., bounce) of the machine 100. For example, in some embodiments, the machine 100 may include a bounce sensor in the form of an accelerometer 240, which may provide an acceleration signal indicative of measured acceleration of the machine 100, for example, relative to a gravity reference. The accelerometer 240 may provide measurements in several degrees of freedom (such as six degrees of freedom; e.g., fore-aft, lateral, and vertical directions as well as pitch, roll, and yaw). In some embodiments, the accelerometer 240 may be a three-axis accelerometer providing an acceleration signal indicative of measured acceleration of the machine 100 along fore-aft, lateral, and vertical directions. In some embodiments, the accelerometer 240 may be a single-axis accelerometer providing the measurement of the mixed acceleration of the machine 100 along fore-aft, lateral, and vertical directions. The accelerometer 240 may be positioned in a suitable location on the machine 100, such as near the rear wheels 150 or near the operator cab 140. In some embodiments, positioning the accelerometer 240 near the operator may result in the movement sensed by the accelerometer 240 generally matching movement sensed by the operator. In some embodiments, the accelerometer 240 may be positioned in a rear bumper of the machine 100 or near the moldboard 125.

In some embodiments, the machine 100 may include a bounce sensor in the form of one or more hydraulic pressure sensors 245 (see FIG. 1) associated with some or all of the hydraulic cylinders used to control aspects of the moldboard 125. In some embodiments, systems monitor the pressure in the hydraulic cylinders to detect bounce. In further embodiments, other types of sensors may be used to detect bounce.

The machine 100 may include an anti-bounce control system 250 to control the anti-bounce aspects or functionality of the machine 100 (e.g., automatic articulation and/or steering). FIG. 2 indicates the anti-bounce control system 250 is generally inclusive of several components of the machine 100. In some embodiments, the anti-bounce control system 250 may control other aspects or functionality of the machine 100 in addition to the anti-bounce aspects or functionality of the machine 100. The control system 250 may include a controller 255. The controller 255 may receive operator input command signals and control the operation of various systems or aspects of the machine 100. The controller 255 may be suitably positioned at any convenient location in or on the machine 100. The control system 250 may include one or more input devices (such as steering and/or throttle controls and/or other aspects of an operator interface 155, see FIG. 1) to control the machine 100. The control system 250 may also include the one or more bounce sensors (e.g., the accelerometer 240 and/or the hydraulic pressure sensors 245) to provide data and other input signals representative of various operating parameters of the machine 100. The controller 255 is programmed with instructions that, when executed, detect bounce (e.g., using the one or more bounce sensors) and control the steering and/or articulation of the machine 100 to reduce (e.g., minimize or stop) bounce, as explained in further detail below.

Figure 3:
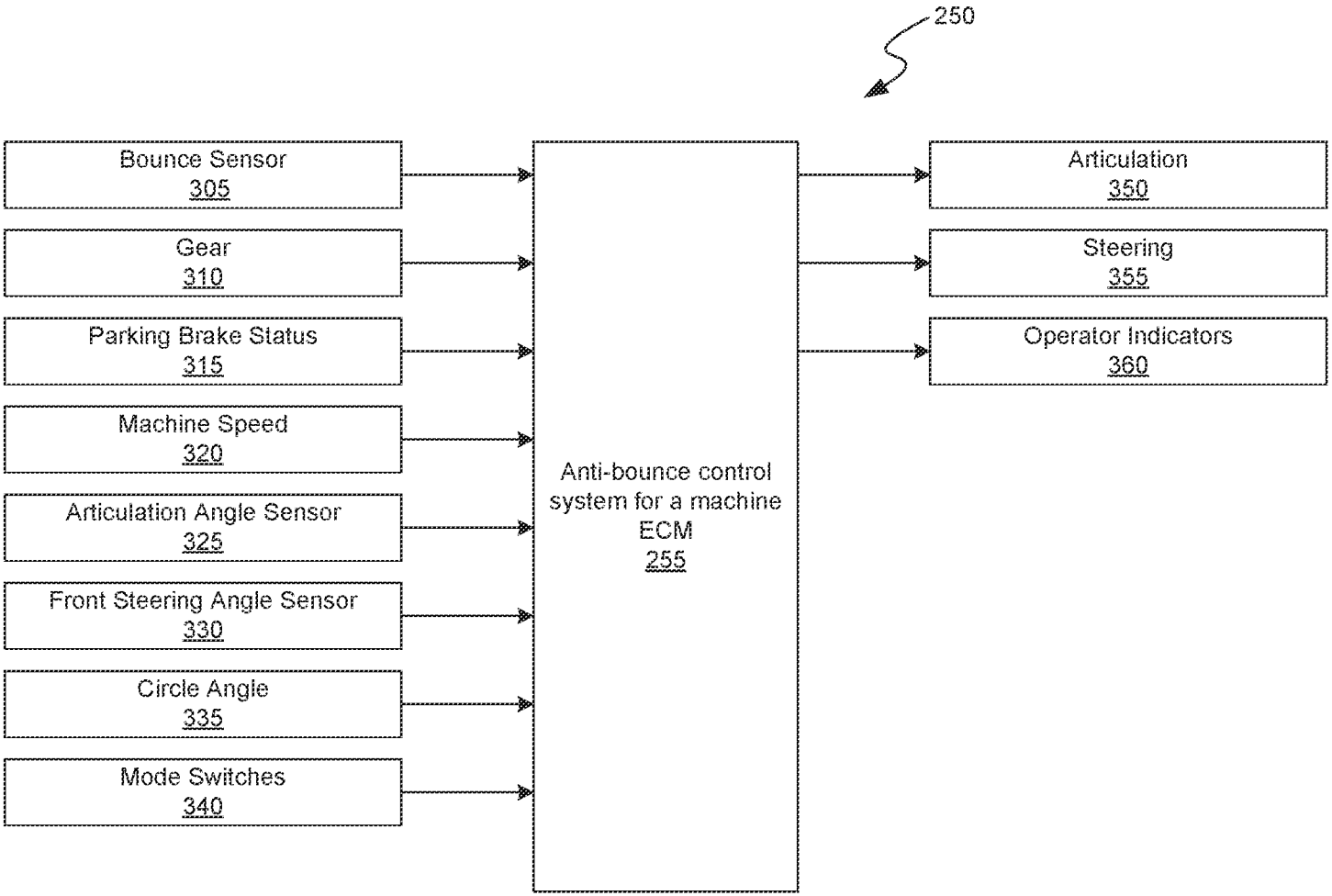
FIG. 3 is a block diagram of an anti-bounce control system configured in accordance with embodiments of the present technology.

FIG. 3 is a block diagram of at least part of an anti-bounce control system 250 configured in accordance with embodiments of the present technology. The controller 255 receives information from various sensors and systems of the machine 100, processes the information, and controls the steering and/or articulation of the machine 100. The controller 255 may receive, at a node 305, a bounce signal or signals from a bounce sensor indicative of the bounce of the machine 100. The bounce sensor may be the accelerometer 240 and/or the one or more hydraulic pressure sensors 245 associated with the moldboard 125.

At node 310, the controller 255 may receive a signal regarding the gear in which the transmission of the machine 100 has been set. In some embodiments, the signal may be generated by another aspect of the control system 250 or of the machine 100 that controls the operation of the transmission of the machine 100. At node 315, the controller 255 may receive a signal regarding whether the parking brake of the machine 100 is engaged. The parking brake signal may be provided by a parking brake sensor 260 (see FIG. 2). At node 320, the controller 255 may receive a signal indicative of the speed of the machine 100 (for example, from a wheel speed sensor 265 shown in FIG. 2 or another suitable device for sending machine speed). At node 325, the controller 255 may receive a signal indicative of the angle of articulation of the machine 100. The articulation angle may be provided by the articulation angle sensor 227 (see FIG. 2). At node 330, the controller 255 may receive a signal indicative of the front steering angle of the machine 100. The front steering angle may be provided by the front steering angle sensor 218 (see FIG. 2). At node 335, the controller 255 may receive a signal indicative of the circle angle of the machine 100. The circle angle may be provided by the circle angle sensor 138 (see FIG. 2). At node 340, the controller 255 may receive a mode signal indicative of the operation mode selected by an operator (e.g., a signal to enable the anti-bounce feature or a signal to disable the anti-bounce feature). The mode signal may be provided by a mode switch 270 controlled by the operator, which may be positioned in the operator cab 140 or at another suitable location (see FIG. 1). Modes may include enabling anti-bounce, disabling anti-bounce, and/or automatically enabling or disabling anti-bounce. For example, changing the articulation angle A2 increases the effective width of the machine 100. An operator may determine that the workspace is too narrow for articulation and therefore may decide to prevent the anti-bounce system from operating to cause articulation.

In some embodiments, the controller 255 may generate various output signals based upon the operation of the anti-bounce control system. At node 350, the controller 255 may provide an articulation angle command signal to control the articulation angle A2 (see FIG. 2). At node 355, the controller 255 may provide a steering command signal to control the front wheel steering angle A1 (see FIG. 2).

At node 360, the controller 255 may provide one or more operator indicator signals to communicate to the operator or to other aspects of the anti-bounce control system 250 the status of the anti-bounce control system 250. For example, operator indicator signals may include an indication that anti-bounce is enabled or disabled, an indication that anti-bounce is set to automatically enable or disable, and/or an indication that bounce is detected. The signals and indications may be manifested in lighting and/or graphics on a display visible to an operator. More specifically, for example, if the machine 100 is not in a bounce condition, the indicator may be off. If the machine 100 is experiencing bounce and the anti-bounce control functionality is operating, the indicator may be on. If the machine 100 is in a bounce condition but the anti-bounce control functionality is not operating, the indicator may be flashing or otherwise indicating such a status. Examples of when the machine 100 may be in a bounce condition but the anti-bounce control functionality is not operating include when the operator has turned off the anti-bounce control functionality (e.g., with the mode switch 270) or when other systems of the machine 100 that control steering and/or articulation have a higher priority and take precedence over the anti-bounce control functionality (such as manual override by an operator).

The controller 255 may be an electronic controller that operates in a logical fashion to perform operations, execute control algorithms, store and retrieve data, and other desired operations. The controller 255 may include or access memory, secondary storage devices, processors, and any other components for running an application. The memory and secondary storage devices may be in the form of read-only memory (ROM) or random access memory (RAM) or integrated circuitry that is accessible by the controller 255. Various other circuits may be associated with the controller 255 such as power supply circuitry, signal conditioning circuitry, driver circuitry, and other types of circuitry.

The controller 255 may be a single controller or may include more than one controller disposed to control various functions and/or features of the machine 100. The term "controller" is meant to be used in its broadest sense to include one or more controllers and/or microprocessors that may be associated with the machine 100 and that may cooperate in controlling various functions and operations of the machine. The functionality of the controller 255 may be implemented in hardware and/or software. The controller 255 may rely on one or more data maps relating to the operating conditions of the machine 100 that may be stored in the memory of the controller 255 or in memory connected to the controller 255. Each of these maps may include a collection of data in the form of tables, graphs, and/or equations.

The controller 255 may be configured to receive as input values the amplitudes of movement of the machine 100 at certain frequencies at which bounce is likely to occur. Threshold values of the amplitude of the machine movement at each of specified or predetermined frequencies may be stored as a portion of the data maps to assist in determining the existence of a bounce condition. Maps of responses to machine bounce exceeding the threshold value may be established and stored within the controller 255 or in memory associated with the controller 255. Such maps may utilize various factors including the articulation angle A2, the front wheel steering angle A1, the extent to which the amplitude of the bounce exceeds the threshold value, and the frequency of the bounce condition. Other operating conditions and characteristics of the machine 100 may also be related in the data maps.

Figure 4:
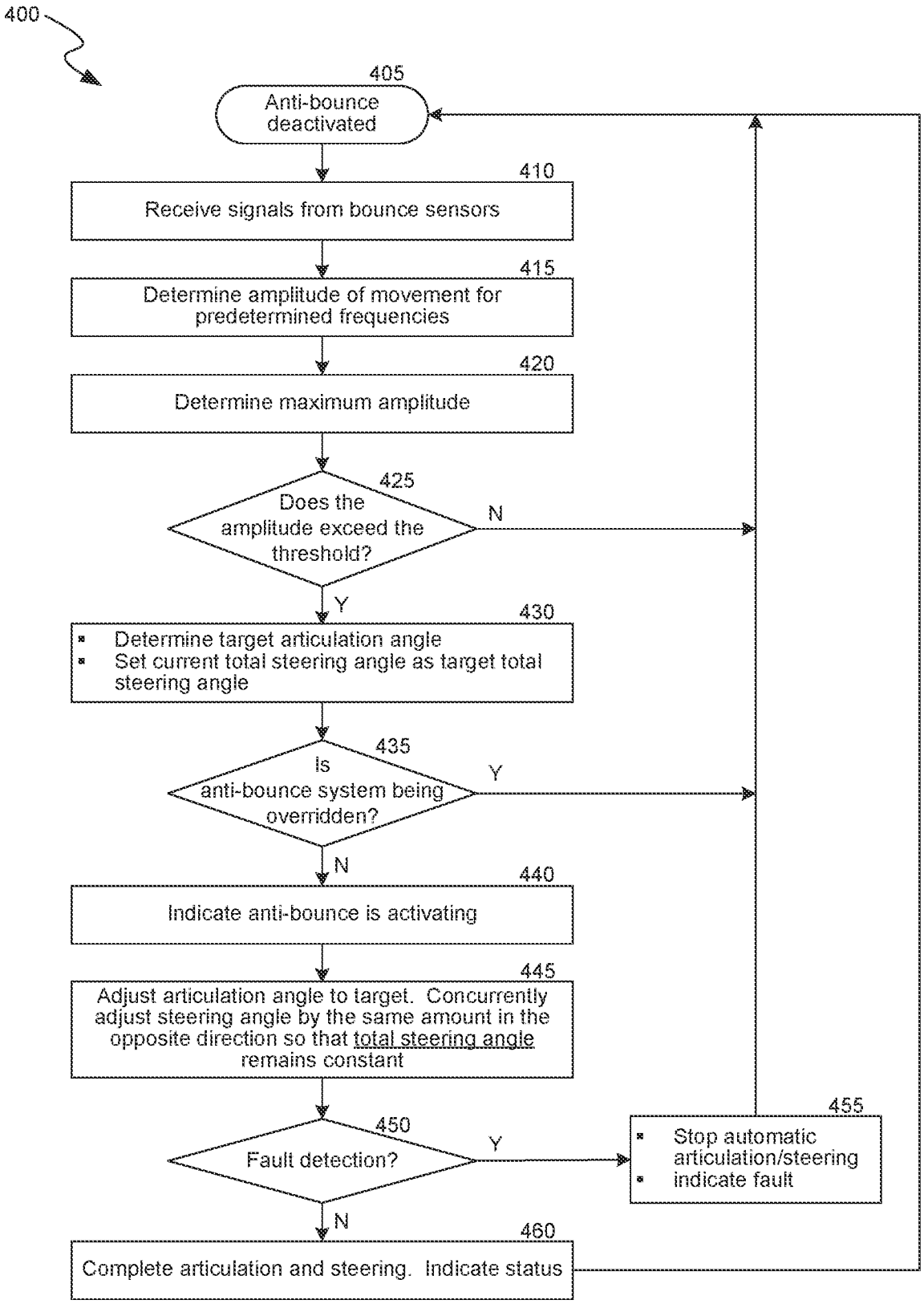
FIG. 4 is a flow diagram illustrating a method for controlling (mitigating) bounce in a machine.

FIG. 4 is a flow diagram illustrating a method 400 for controlling (mitigating) bounce in a machine. The method 400 reduces bounce by adjusting articulation and/or steering when bounce is detected. If the system 250 is enabled, the system 250 may operate in accordance with the method 400. If the system 250 is disabled, the machine 100 may be operated without performing the method 400. Systems (such as the system 250) configured in accordance with embodiments of the present technology include one or more controllers (e.g., the controller 255) programmed with instructions that, when executed carry out the method 400.

At step 405, the system 250 begins with the anti-bounce auto-articulation feature deactivated, such that articulation is not under the control of the system 250. At step 410, the controller 255 receives bounce signals from the bounce sensors (such as the accelerometer 240 and/or the one or more hydraulic pressure sensors 245) that are indicative of movement of the machine 100. The natural frequency of each machine 100 is a function of several characteristics including weight and weight distribution, machine dimensions, and the tire characteristics. Bounce at the natural frequency could be triggered by various operating conditions encountered by the machine 100 (such as soil conditions and profile, blade movement, and gear and speed changes). Accordingly, at step 415, the controller 255 analyzes and determines the amplitude of movement of the machine 100 within certain frequency ranges associated with the machine 100. The frequency ranges may be determined by experimentation or calculation.

In an example of vertical bounce of a machine 100, the controller 255 may analyze vertical movement of the machine 100 within a frequency range of between approximately 1.5 and 3 Hz. When performing such analysis, the controller 255 may analyze at step 420 the amplitude of vertical movement at each frequency within the range and determine the maximum amplitude of movement as well as the frequency of such maximum movement. In examples of both pitch and side-to-side bounce, the frequency range analyzed by the controller 255 may overlap with or be different from the frequency range of the vertical bounce. For each type of movement, at step 420, the controller 255 may analyze the amplitude of the particular movement at each frequency within the range and determine the maximum amplitude of the movement as well as the frequency of such maximum movement.

At step 425, the controller 255 determines whether the maximum amplitude of movement exceeds a predetermined threshold. In some embodiments, this may be carried out by comparing the maximum amplitude to data maps corresponding to the specific frequency (the data maps may be stored in a memory associated with the controller 255). If the maximum amplitude does not exceed the predetermined threshold, the anti-bounce control functionality is not activated (remains deactivated), the machine 100 will operate in accordance with the operator's commands for steering and articulation, and the process flow may return to step 405.

If the maximum amplitude does exceed the predetermined threshold, at step 430, the controller 255 may determine a target articulation angle (to be used as the angle A2 in FIG. 2) and a target total steering angle (to be used as the angle A3 in FIG. 2). In some embodiments, the target articulation angle may be the same for some types of machines or groups of machines 100. In some embodiments, the target articulation angle may be approximately 5 degrees. In some embodiments, the target articulation angle may be unique to the configuration of the machine 100. In some embodiments, the target articulation angle is a constant regardless of the amount of bounce (e.g., regardless of the amplitude or frequency). In some embodiments, the controller 255 or another aspect of the system 250 determines the target articulation angle based on the amplitude and/or frequency of bounce, as described in additional detail below.

Changing the articulation angle A2 changes the trajectory of the machine 100 by effectively changing the steering of the machine 100. Systems configured in accordance with some embodiments of the present technology may automatically adjust the front wheel steering angle A1 to maintain the total steering angle A3 to keep the machine 100 on course despite the articulation maneuver to control bounce. In some embodiments, the operator may manually control the front wheel steering angle A1 to counteract the articulation angle A2. However, in some embodiments, the controller 255 determines the current total steering angle (A3, see FIG. 2) at the time the maximum amplitude exceeds the predetermined threshold. The system 250 sets the current total steering angle as the target total steering angle. In other words, in some embodiments, the system 250 sets the target total steering angle to preserve the course of the machine 100 prior to the bounce condition. The target articulation angle and the target total steering angle may be saved in a memory associated with the controller 255.

Next, at step 435, the controller 255 determines whether any other subsystems or aspects of the machine 100 have priority over the auto-articulation anti-bounce control functionality. For example, the controller 255 may override the system and prevent it from operating while the machine 100 is in a park gear, while it is stationary, or while it is moving at high speeds (for example, the controller 255 may override the system and prevent it from operating when the machine is traveling at 17 miles per hour or more, or other speeds depending on machine 100 configuration). In some embodiments, the controller 255 may recognize an override command from an operator activating an override switch, button, or other interface (such as the mode switch 270 described above).

If the controller 255 determines that the auto-articulation anti-bounce control functionality is being overridden, the method 400 may return to step 405 and keep the anti-bounce auto-articulation feature deactivated and the machine 100 will operate without auto-articulating. However, if the controller 255 determines that the auto-articulation anti-bounce control functionality is not being overridden, then at step 440, the system 250 may indicate to an operator that the anti-bounce auto-articulation feature is activating (for example, via a noise, a light, and/or information in a display). In some embodiments, the indication allows an operator time to react to the feature and to determine whether to allow the auto-articulation to occur (e.g., by giving the operator a moment to press the mode switch 270 or to operate another interface to disable the system 250).

If the auto-articulation anti-bounce control functionality is not being overridden, then at step 445, the controller 255 generates a command to adjust the articulation angle A2 to the target articulation angle, and the machine 100 responds to adjust the articulation angle A2 to the target articulation angle. The adjustment may be initiated concurrently with the indication in step 440 or just before or after the indication in step 440. Concurrently with the articulation, the controller 255 generates a command to adjust the front wheel steering angle A1 in the opposite direction from the articulation angle A2, so that the target total steering angle A3 is unchanged by the auto-articulation functionality. In some embodiments, the operator may manually control the front wheel steering angle A1. In some embodiments, the operator may interrupt the articulation maneuver (for example, for safety or other reasons) using an interface such as the mode switch 270.

Concurrent with the articulation and/or steering maneuver in step 445, at step 450, the controller 255 may carry out a fault detection operation. In some embodiments, the fault detection operation includes determining whether the machine 100 does not maintain course during or after the articulation and/or steering maneuver in step 445. In some embodiments, an intent of the system 250 is to maintain the total steering angle while articulation and/or steering are actuated (as described above) to keep the machine 100 on course within a tolerance.

If the actual total steering angle deviates from the target total steering angle more than a threshold or tolerated amount, the controller 255 will register a fault, and at step 455, the controller 255 may stop the automatic articulation and/or steering function and indicate the fault to the operator (for example, via a noise, a light, and/or information in a display). In some embodiments, the next step in the method 400 (after stopping the articulation and/or steering due to the fault) may include returning to step 405, where the auto-articulation anti-bounce control functionality is deactivated. In some embodiments, an operator may determine how to respond to the fault (for example, by slowing down or adapting to an environmental condition, or performing a repair, etc.).

In some embodiments, the deviation threshold depends on the actual total steering angle, the target total steering angle, the machine speed, and one or more of the machine dimensions (e.g., the machine width). For example, at low machine speeds, the deviation threshold may be higher than at higher speeds because it will take the machine 100 longer to deviate from its course. At higher machine speeds, the deviation threshold may be lower than at lower speeds because the machine 100 will deviate from its course faster. In some embodiments, the maximum deviation threshold may be X degrees angle error for Y seconds, where X and Y are dependent on machine speed. In some embodiments, the maximum deviation threshold may be a cumulative sum CUSUM of angle error, where the CUSUM threshold also depends on machine speed. In general, embodiments of the present technology maintain the total steering angle close to the original steering angle prior to automatic articulation and/or steering in order to keep the machine 100 on course, while allowing some amount of deviation that may be programmed and/or predetermined by machine operators.

If the controller 255 does not detect a fault, then in step 460, the articulation and/or steering function continues (as directed by the controller 255). Upon completion, the anti-bounce articulation function is deactivated and set to idle until bounce is detected again.

The machine 100 may experience one or more of three different types of bounce conditions (i.e., vertical, pitch, and side-to-side) at different frequencies. In other words, vertical bounce may occur in a first direction and at a first frequency, bounce in a pitch direction may occur in a second direction and at a second frequency, and/or side-to-side bounce may occur in a third direction and at a third frequency. They may not occur at identical frequencies. The data maps of the controller 255 may contain data for each type of bounce and the process set forth in FIG. 4 may be repeated (simultaneously or sequentially) for each type of bounce. In some embodiments, the controller 255 may determine a command signal to reduce or eliminate each type of bounce but only transmit the command signal to reduce the largest bounce or the bounce that is preprogrammed to be the most detrimental (for example, the bounce with the harshest amplitude and frequency). In some embodiments, the controller 255 may only set the target articulation angle to adapt to the largest bounce or the most detrimental bounce.

Figure 5:
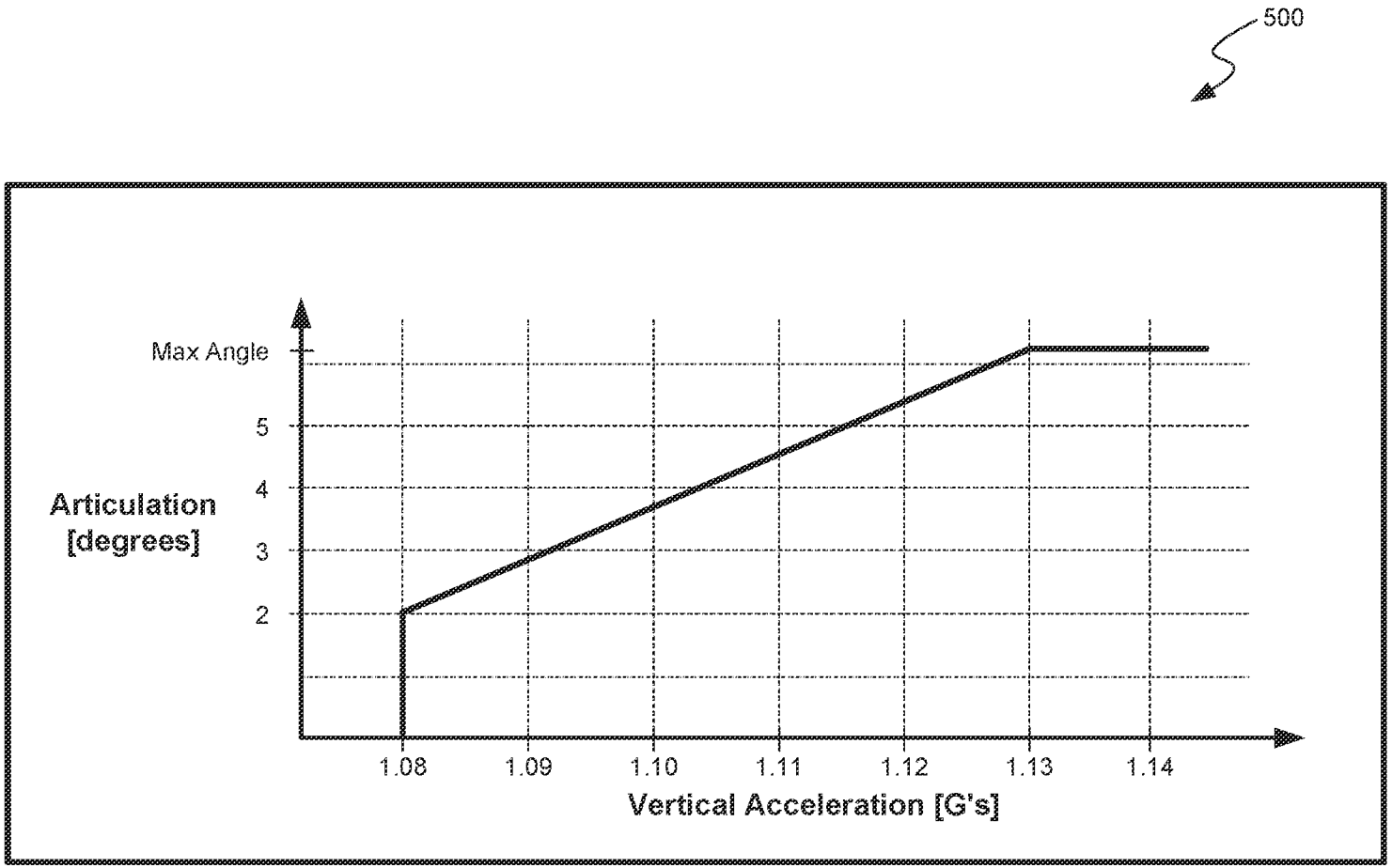
FIG. 5 illustrates a representative data map to determine a target articulation angle in accordance with embodiments of the present technology.

FIG. 5 illustrates a representative data map 500 to determine a target articulation angle in accordance with embodiments of the present technology. The data map 500 shown in FIG. 5 is an example only. In some embodiments, the bounce sensors (e.g., the accelerometer 240) may produce a signal indicative of a vertical acceleration value, such as the G-force associated with the bounce amplitude. The data map 500 may be stored in a memory associated with the controller 255 for the controller 255 to determine the target articulation angle. For example, if the vertical acceleration at maximum bounce amplitude for a given frequency of the machine 100 is 1.11 G, the target articulation angle may be set to 5 degrees. In other embodiments, other angles may be used.

In some embodiments, the direction of the articulation angle A2 may be set by the operator or automatically. For example, the mode switch 270 may input into the controller 255 a setting regarding whether to articulate so that the rear frame 110 moves closer to the toe T of the moldboard 125, or so that the rear frame 110 moves closer to the heel H of the moldboard 125. An operator may determine the appropriate direction of articulation (e.g., left or right or towards or away from the toe T) based on the operating environment.

In general, embodiments of the present technology may automatically steer and/or articulate the machine 100 such that the articulation angle A2 is approximately two to five degrees (or other suitable angles) and the front wheel steering angle A1 may be the negative of the articulation angle A1. The articulation and steering may move the front tires to one side or the other by about a multiple of the width of the tires on the front wheels 135 (such as 1.5 times the width of a front tire). Such a configuration has been demonstrated to reduce bounce in straight travel at least partly because it may position one of the front wheels 135 slightly ahead of the other, so that one wheel is on top of an inconsistency while the other is at the bottom of an inconsistency, which decreases resonance effects.

Suitable System

The techniques disclosed herein can be embodied as special-purpose hardware (e.g., circuitry), as programmable circuitry appropriately programmed with software and/or firmware, or as a combination of special-purpose and programmable circuitry. Hence, embodiments may include a machine-readable medium having stored thereon instructions which may be used to cause a computer, a microprocessor, processor, and/or microcontroller (or other electronic devices) to perform a process. The machine-readable medium may include, but is not limited to, optical disks, compact disc read-only memories (CD-ROMs), magneto-optical disks, ROMs, random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions.

Figure 6:
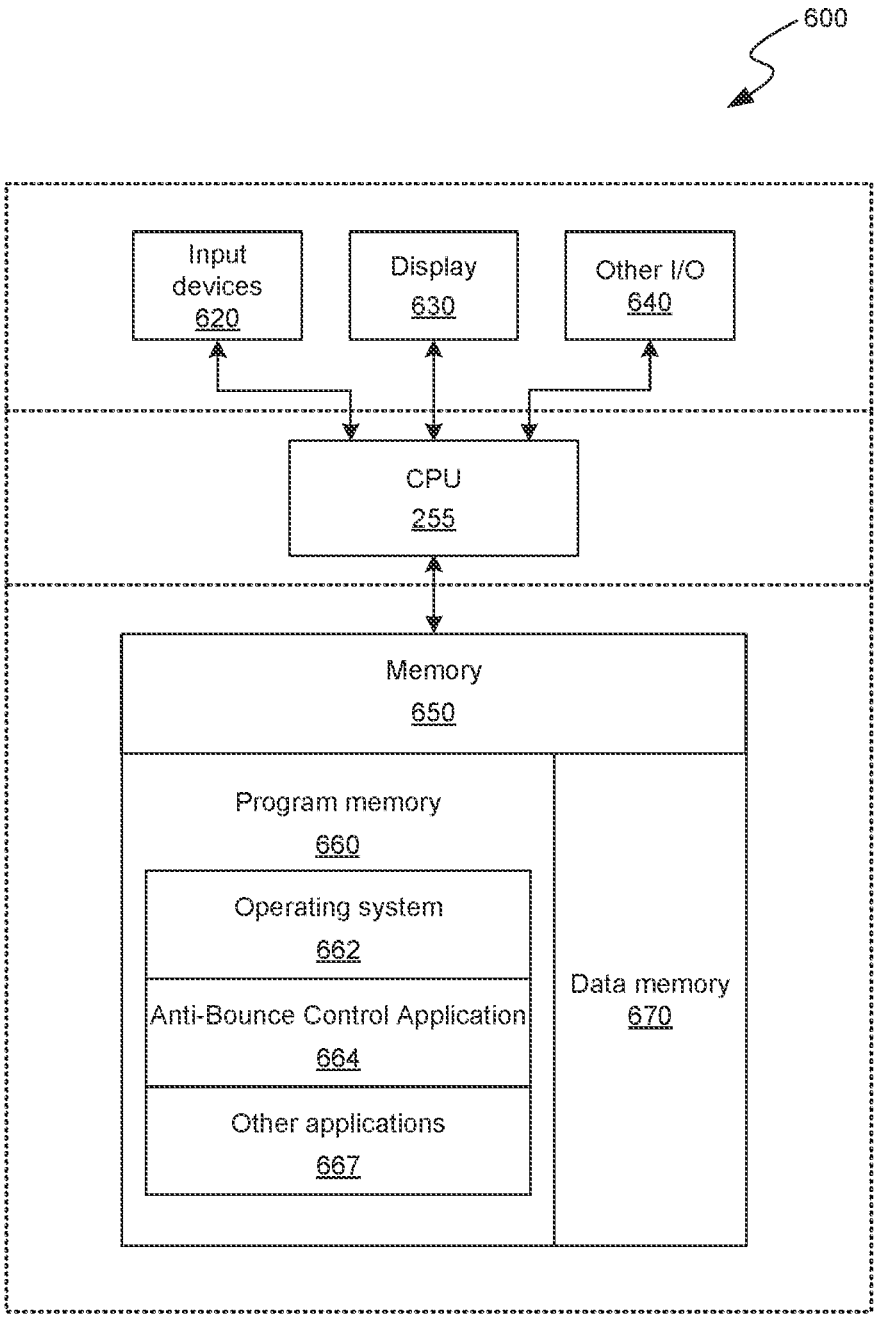
FIG. 6 is a block diagram illustrating an overview of devices on which some implementations of the disclosed technology can operate.

Several implementations are discussed below in more detail in reference to the Figures. FIG. 6 is a block diagram illustrating an overview of devices on which some implementations of the disclosed technology can operate. The devices can comprise hardware components of a system 250 that performs anti-bounce articulation and/or steering, for example. Device 600 can include one or more input devices 620 that provide input to the controller 255 (which may be in the form of a CPU), notifying it of actions. The actions are typically mediated by a hardware controller that interprets the signals received from the input device and communicates the information to the controller 255 using a communication protocol. Input devices 620 include, for example, a mouse, a keyboard, a touchscreen, an infrared sensor, a touchpad, a wearable input device, a camera- or image-based input device, a microphone, a switch, or other user input devices.

The controller 255 can be a single processing unit or multiple processing units in a device or distributed across multiple devices. The controller 255 can be coupled to other hardware devices, for example, with the use of a bus, such as a PCI bus or SCSI bus. The controller 255 can communicate with a hardware controller for devices, such as for a display 630. The display 630 can be used to display text and graphics. In some examples, display 630 provides graphical and textual visual feedback to a user, such as a status of the system 250. In some implementations, display 630 includes the input device as part of the display, such as when the input device is a touchscreen or is equipped with an eye direction monitoring system. In some implementations, the display 630 is separate from the input device. Examples of display devices are: an LCD display screen; an LED display screen; a projected, holographic, or augmented reality display (such as a heads-up display device or a head-mounted device); and so on. Other I/O devices 640 can also be coupled to the processor, such as a network card, video card, audio card, USB, FireWire or other external device, sensor, camera, printer, speakers, CD-ROM drive, DVD drive, disk drive, or Blu-Ray device. Other I/O devices 640 can include sensors disclosed herein and other controllers for controlling the articulation and/or steering of the machine 100 (see FIG. 3).

In some implementations, the device 600 also includes a communication device capable of communicating wirelessly or wire-based with a network node. The communication device can communicate with another device or a server through a network using, for example, LIN, CAN, FlexRay, Ethernet, and/or TCP/IP protocols. The device 600 can utilize the communication device to distribute operations across multiple network devices.

The controller 255 can have access to a memory 650. A memory 650 includes one or more of various hardware devices for volatile and non-volatile storage, and can include both read-only and writable memory. For example, a memory 650 can comprise random access memory (RAM), CPU registers, read-only memory (ROM), and writable non-volatile memory, such as flash memory, hard drives, floppy disks, CDs, DVDs, magnetic storage devices, tape drives, device buffers, and so forth. A memory 650 is not a propagating signal divorced from underlying hardware; a memory is thus non-transitory. Memory 650 can include program memory 660 that stores programs and software, such as an operating system 662, an Anti-Bounce Control Application 664 (which may include instructions for carrying out the methods of scheduling maintenance disclosed herein), and other application programs 667. Memory 650 can also include data memory 670 that can include database information, etc. (such as data maps for determining the target articulation and steering angles), which can be provided to the program memory 660 or any element of the device 600.

Some implementations can be operational with numerous other general purpose or special purpose computing system environments or configurations. Examples of well-known computing systems, environments, and/or configurations that may be suitable for use with the technology include, but are not limited to, personal computers, server computers, handheld or laptop devices, cellular telephones, mobile phones, wearable electronics, gaming consoles, tablet devices, multiprocessor systems, microprocessor-based systems, set-top boxes, programmable consumer electronics, network PCs, minicomputers, mainframe computers, distributed computing environments that include any of the above systems or devices, or the like.

Figure 7:
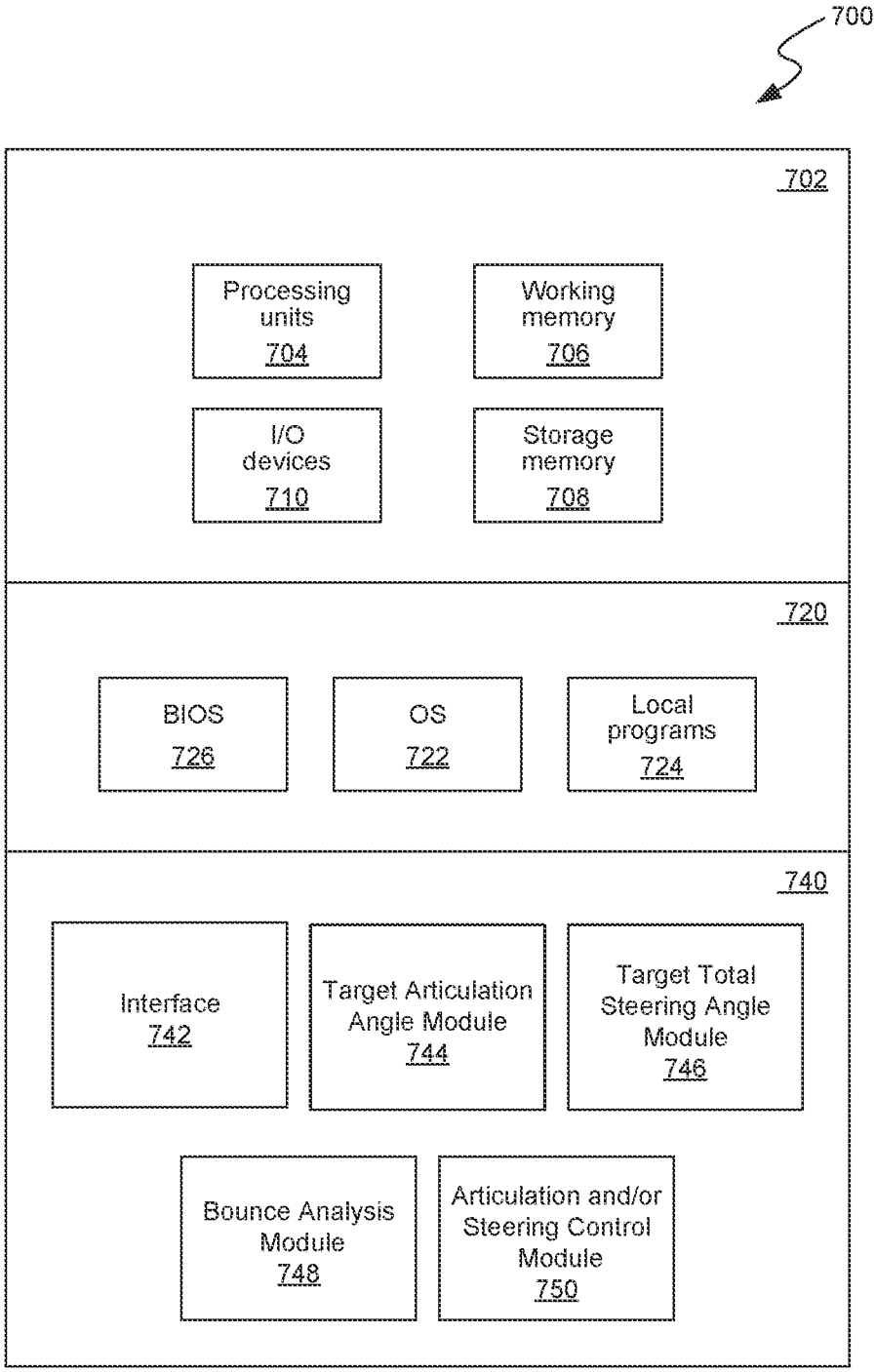
FIG. 7 is a block diagram illustrating elements which, in some implementations, can be used in a system employing the disclosed technology.

FIG. 7 is a block diagram illustrating elements 700 which, in some implementations, can be used in a system employing the disclosed technology. The elements 700 include hardware 702, general software 720, and specialized elements 740. As discussed above, a system implementing the disclosed technology can use various hardware, including processing units 704 (e.g., CPUs, GPUs, APUs, etc.), working memory 706, storage memory 708, and input and output devices 710. Elements 700 can be implemented in a computing device onboard a machine 100 or on a server computing device remote from the machine 100.

General software 720 can include various applications, including an operating system 722, local programs 724, and a basic input output system (BIOS) 726. Specialized components 740 can be subcomponents of a general software application 720, such as local programs 724, which may include the Anti-Bounce Control Application 664 (see FIG. 6 and description above). Specialized elements 740 can include a Target Articulation Angle Module 744 (for determining the target articulation angle based on a data map or a set value according to a machine configuration as explained above), a Target Total Steering Angle Module 746 (for determining a target total steering angle, as explained above), a Bounce Analysis Module 748 (for analyzing bounce), an Articulation and/or Steering Control Module 750 (for instructing the machine 100 to operate to articulate and/or steer based on instructions from the controller 255 and/or for detecting and reacting to faults), and components that can be used for controlling the specialized components, such as interface 742. In some implementations, elements 700 can be in a computing system that is distributed across multiple computing devices or can be an interface to a server-based application executing one or more of specialized elements 740.

Those skilled in the art will appreciate that the components illustrated in FIGS. 3, 6, and 7 described above, and in each of the flow diagrams discussed above, may be altered in a variety of ways. For example, the order of the logic or steps may be rearranged, steps may be performed in parallel (concurrently or nearly simultaneously), illustrated logic or steps may be omitted, other logic or steps may be included, etc. In some implementations, one or more of the components described above can execute one or more of the processes described herein.

INDUSTRIAL APPLICABILITY

Embodiments of the present technology are applicable to machines 100 such as motor graders, for which harmonic vibrations or bounce may affect their operation. Individual characteristics of the machine 100 as well as the operating conditions and environment affect the natural frequency of each machine. The anti-bounce control systems disclosed herein determine the natural frequency of the machine 100 by analyzing movement of the machine 100, determining the maximum amplitude of movement and the frequency at which such movement occurs. The controller 255 may then reduce or eliminate the bounce by adjusting the articulation and/or steering of the machine 100 based upon various factors such as the amplitude of the bounce, the natural frequency of the motor grader, the sensed vertical acceleration of the machine 100, the operating conditions, and/or other factors.

Systems configured in accordance with embodiments of the present technology reduce bounce of a machine in order to reduce inefficiencies and increase productivity. Embodiments of the present technology may be implemented even when the moldboard 125 is not engaged with the ground (for example, to reduce bounce when a machine 100 is traveling between locations, to increase operator comfort and/or safety).

In some embodiments, anti-bounce control systems can include a Target Articulation Angle Module 744, a Target Total Steering Angle Module 746, a Bounce Analysis Module 748, and an Articulation and/or Steering Control Module 750 (FIG. 7).

In operation, the Bounce Analysis Module 748 may receive signals from bounce sensors, analyze the amplitude of movement for the bouncing and determine the maximum amplitude of the bouncing, and determine if the amplitude exceeds a pre-programmed acceptable threshold (see steps 410-425 in FIG. 4). The Target Articulation Angle Module 744 determines a target articulation angle (see step 430 in FIG. 4). The Target Articulation Module may include and/or use one or more data maps 500 (see FIG. 5) to determine the target articulation angle. The Target Total Steering Angle Module 746 determines and sets the target total steering angle (see step 430 in FIG. 4). The Articulation and/or Steering Control Module 750 may determine if the system is being overridden, indicate that anti-bounce functionality (steering and/or articulation) is activating, control the articulation and steering angles based on their determined targets, and detect and react to faults (see steps 435-460 in FIG. 4).

General software 720 (see FIG. 7) may include instructions to repeat any one or more of the steps 400 (see FIG. 4) at selected increments of time to continually or periodically analyze and react to the bounce of the machine 100. The disclosed technology, therefore, provides automatic articulation and/or steering to control (e.g., mitigate) bounce of a machine 100. The disclosed technology provides an advantage over speed-based systems because it can mitigate bounce without having to adjust speed away from optimum operating speed. In other words, in order to avoid forcing the machine to operate at its natural resonance frequency, speed-based systems cause the machine to slow down to a speed that can be inefficient with respect to time and fuel usage. Rather than adjusting speed, the disclosed technology adjusts articulation and/or steering angles to mitigate bounce while maintaining optimum speed.

REMARKS

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" (or the like) in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

Unless explicitly excluded, the use of the singular to describe a component, structure, or operation does not prevent the use of plural such components, structures, or operations.

As used herein, the term "and/or" when used in the phrase "A and/or B" means "A, or B, or both A and B." A similar manner of interpretation applies to the term "and/or" when used in a list of more than two terms.

What is claimed is:

1. A method for controlling movement of a motor grader, the motor grader including a front frame and a rear frame, wherein the front frame is configured to articulate relative to the rear frame about an articulation angle; the method comprising:

receiving, at a controller, a bounce signal from a first sensor, wherein the signal is indicative of a bouncing movement of the motor grader;

analyzing, by the controller, the bounce signal from the first sensor, wherein analyzing the bounce signal comprises determining a maximum amplitude of the bouncing movement of the motor grader based on the bounce signal from the first sensor and determining whether the maximum amplitude exceeds an amplitude threshold;

in response to determining whether the maximum amplitude exceeds the amplitude threshold, generating, by the controller, an articulation angle command signal to change the articulation angle; and transmitting the articulation angle command signal from the controller to change the articulation angle.

2. The method of claim 1, further comprising determining a target articulation angle, wherein changing the articulation angle comprises changing the articulation angle to the target articulation angle.

3. The method of claim 2, wherein determining the target articulation angle comprises analyzing the bounce signal from the first sensor.

4. The method of claim 1, wherein the motor grader comprises front wheels that are steerable relative to the front frame along a front wheel steering angle, and wherein the method further comprises:

generating, by the controller, a steering angle command signal to change the front wheel steering angle; and transmitting the steering angle command signal from the controller to change the front wheel steering angle.

5. The method of claim 4, further comprising determining a target total steering angle, wherein the target total steering angle comprises a sum of the articulation angle and the front wheel steering angle at a time when the controller determines the maximum amplitude of the bouncing movement, wherein generating the steering angle command signal comprises generating the steering angle command signal to maintain a total steering angle at the target total steering angle during and after changing the articulation angle.

6. The method of claim 5, further comprising determining an actual total steering angle, and if the actual total steering angle deviates from the target total steering angle by a deviation threshold, stopping the changing of the articulation angle and of the front wheel steering angle.

7. The method of claim 1, wherein receiving a bounce signal from the first sensor comprises receiving a signal from an accelerometer or from a hydraulic pressure sensor.

8. A system for automated control of movement of a motor grader, the motor grader including a front frame and a rear frame, wherein the front frame is configured to articulate relative to the rear frame about an articulation angle, the system comprising:

a first sensor carried by the motor grader and configured to provide a bounce signal indicative of a bouncing movement of the motor grader; and a controller programmed with instructions that, when executed:

receive the bounce signal from the first sensor;

analyze the bounce signal from the first sensor, wherein analyzing the bounce signal comprises determining a maximum amplitude of the bouncing movement of the motor grader based on the bounce signal from the first sensor;

determine whether the maximum amplitude exceeds an amplitude threshold;

in response to determining whether the maximum amplitude exceeds the amplitude threshold, generate an articulation angle command signal to change the articulation angle; and transmit the articulation angle command signal from the controller to change the articulation angle.

9. The system of claim 8, wherein the controller is programmed with instructions that determine a target articulation angle, and wherein changing the articulation angle comprises changing the articulation angle to the target articulation angle.

10. The system of claim 9, wherein the controller is programmed with instructions that, when executed, analyze the bounce signal from the first sensor to determine the target articulation angle.

11. The system of claim 8, wherein the motor grader comprises front wheels that are steerable relative to the front frame along a front wheel steering angle, and wherein the controller is programmed with instructions that, when executed:

generate a steering angle command signal to change the front wheel steering angle; and transmit the steering angle command signal from the controller to change the front wheel steering angle.

12. The system of claim 11, wherein the controller is programmed with instructions that, when executed, determine a target total steering angle, wherein the target total steering angle comprises a sum of the articulation angle and the front wheel steering angle at a time when the controller determines the maximum amplitude of the bouncing movement, wherein generating the steering angle command signal comprises generating the steering angle command signal to maintain a total steering angle at the target total steering angle during and after changing the articulation angle.

13. The system of claim 12, wherein the controller is programmed with instructions that, when executed, determine an actual total steering angle, and if the actual total steering angle deviates from the target total steering angle by a deviation threshold, stop the changing of the articulation angle and of the front wheel steering angle.

14. The system of claim 8, wherein the first sensor comprises an accelerometer or a hydraulic pressure sensor.

15. A motor grader comprising:

a rear frame;

a front frame, wherein the front frame is configured to articulate relative to the rear frame about an articulation angle;

a first sensor carried by the motor grader and configured to provide a bounce signal indicative of a bouncing movement of the motor grader, wherein the first sensor comprises an accelerometer or a hydraulic pressure sensor; and a controller programmed with instructions that, when executed:

receive the bounce signal from the first sensor;

analyze the bounce signal from the first sensor, wherein analyzing the bounce signal comprises determining a maximum amplitude of the bouncing movement of the motor grader based on the bounce signal from the first sensor;

determine whether the maximum amplitude exceeds an amplitude threshold;

in response to determining whether the maximum amplitude exceeds the amplitude threshold, generate an articulation angle command signal to change the articulation angle; and transmit the articulation angle command signal from the controller to change the articulation angle.

16. The motor grader of claim 15, wherein the controller is programmed with instructions that determine a target articulation angle, and wherein changing the articulation angle comprises changing the articulation angle to the target articulation angle.

17. The motor grader of claim 16, wherein the controller is programmed with instructions that, when executed, analyze the bounce signal from the first sensor to determine the target articulation angle.

18. The motor grader of claim 15, wherein the motor grader comprises front wheels that are steerable relative to the front frame along a front wheel steering angle, and wherein the controller is programmed with instructions that, when executed:

generate a steering angle command signal to change the front wheel steering angle; and transmit the steering angle command signal from the controller to change the front wheel steering angle.

19. The motor grader of claim 18, wherein the controller is programmed with instructions that, when executed, determine a target total steering angle, wherein the target total steering angle comprises a sum of the articulation angle and the front wheel steering angle at a time when the controller determines the maximum amplitude of the bouncing movement, wherein generating the steering angle command signal comprises generating the steering angle command signal to maintain a total steering angle at the target total steering angle during and after changing the articulation angle.

20. The motor grader of claim 19, wherein the controller is programmed with instructions that, when executed, determine an actual total steering angle, and if the actual total steering angle deviates from the target total steering angle by a deviation threshold, stop the changing of the articulation angle and of the front wheel steering angle.

* * * * *